United States Patent [19]

Fuchs, Jr.

[11] 4,094,178

[45] June 13, 1978

[54] METHODS FOR CONTINUOUS EXTRUSION

[75] Inventor: Francis Joseph Fuchs, Jr., Princeton Junction, N.J.

[73] Assignee: Western Electric Co., Inc., New York, N.Y.

[21] Appl. No.: 664,611

[22] Filed: Mar. 8, 1976

[51] Int. Cl.[2] ..... B21C 31/00; B21B 45/02

[52] U.S. Cl. ..... 72/41; 72/60; 72/270; 72/271

[58] Field of Search ..... 72/41, 60, 88–90, 72/91, 92, 112, 115, 124, 262, 270, 271, 273, 39; 425/224; 140/105

[56] References Cited

U.S. PATENT DOCUMENTS

| | | | |
|---|---|---|---|
| 1,397,271 | 11/1921 | Eckemroth | 72/235 X |
| 2,963,048 | 12/1960 | Smith | 140/105 X |
| 3,136,185 | 6/1967 | Bentler | 72/226 X |
| 3,580,019 | 5/1971 | Beresnev | 72/47 |
| 3,605,473 | 9/1971 | Lyon et al. | 72/401 |
| 3,765,216 | 10/1973 | Green | 72/262 |
| 3,810,371 | 5/1974 | Pisani | 72/39 |
| 3,872,703 | 3/1975 | Green | 72/273 |
| 3,911,705 | 10/1975 | Voorhes | 72/92 |
| 3,922,898 | 12/1975 | Voorhes | 72/270 |

*Primary Examiner*—Leon Gilden
*Attorney, Agent, or Firm*—A. S. Rosen

[57] ABSTRACT

Two rotors cooperate to advance a rod of indefinite length continuously into an extrusion die. Portions of radially extending surfaces of the two rotors are utilized to grip the rod therebetween, in order to effect such advance of the workpiece rod upon the simultaneous rotation of the two rotors. An annular groove extends along the appropriate radially extending surface of one of the rotors. Such annular groove serves to retain the rod therein while guiding the rod along a path leading to the die. The face-to-face arrangement of the two rotors along their respective radially extending surfaces permits a very high extrusion pressure to be supported, while also allowing effective sealing of the annular groove at such very high extrusion pressure.

32 Claims, 9 Drawing Figures

FIG. 2
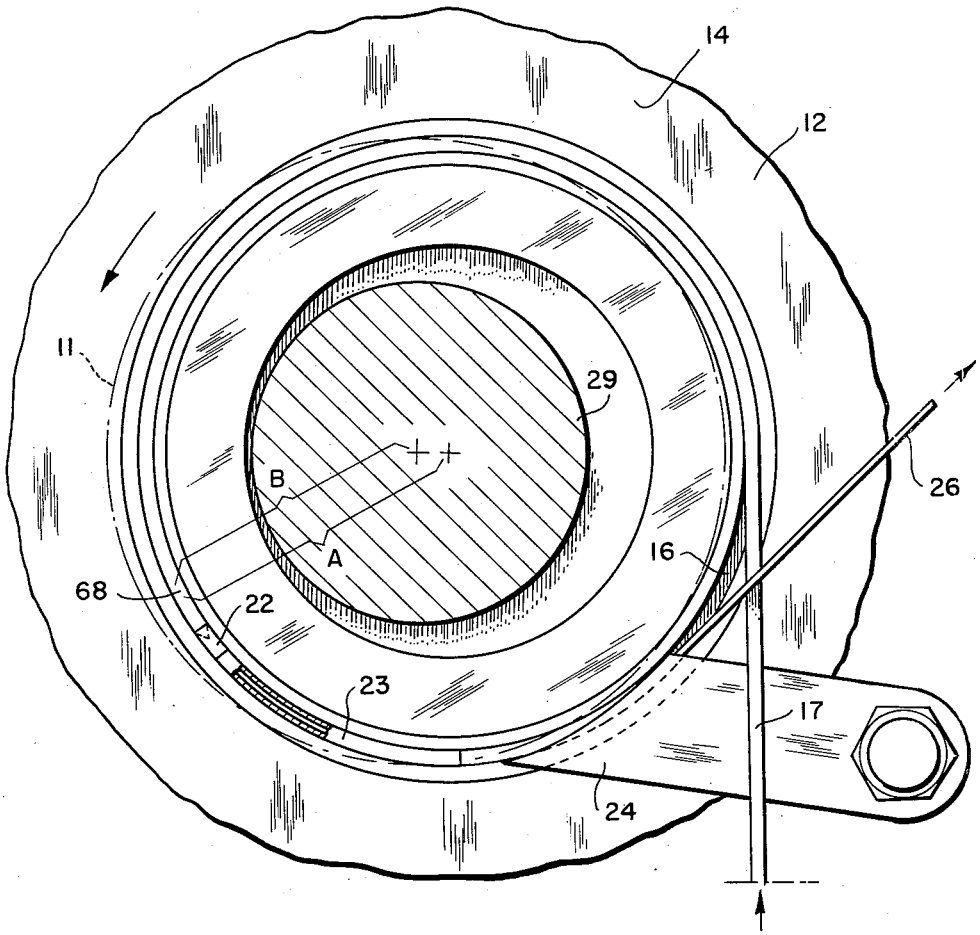
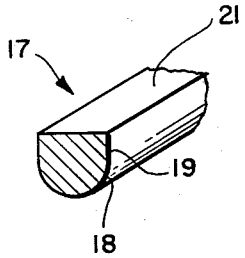
FIG. 3

METHODS FOR CONTINUOUS EXTRUSION

BACKGROUND OF THE INVENTION

1. Field of the Invention

This invention relates to methods for deforming a workpiece and, more particularly, to methods for the continuous extrusion of an elongated workpiece, such as a rod, of indefinite length to form an elongated product, such as a wire, of indefinite length.

2. Description of the Prior Art

In the art of deforming elongated workpieces of indefinite length, so as to form elongated products of indefinite length, continuous hydraulic extrusion techniques are known. For example, my U.S. Pat. No. 3,740,985, an application for the reissue of which has been filed on Jan. 4, 1974 under Ser. No. 430,984, and my copending application, Ser. No. 612,875, filed Sept. 12, 1975, disclose two embodiments of apparatus, and related methods, for the continuous hydrostatic extrusion of elongated products of indefinite length. These embodiments incorporate moving trains of gripping element sectors for applying forces to workpieces of indefinite length through suitable shear-transmitting media. In each of these embodiments, a workpiece is advanced linearly, due to the action of shear forces transmitted by the medium utilized, while being subjected to a pressure gradient increasing in the direction of the linear advance. Once the pressure level has become sufficient to increase workpiece ductility substantially, the workpiece is forced through a die which deforms the workpiece into an elongated product.

It is also known to extrude an elongated product of indefinite length by advancing an elongated workpiece of indefinite length along a curved path toward and through a die, utilizing a single rotary member having a grooved, radially outermost surface. The workpiece is held in the groove of the rotary member by a stationary member located radially outwardly from the rotary member. The contact area between the workpiece and the groove in the rotary member is greater than that between the workpiece and the stationary member, so that an imbalance of friction forces causes the workpiece to advance with the rotary member. Such techniques are disclosed in U.S. Pat. No. 3,765,216 and U.S. Pat. No. 3,872,703, both issued to D. Green, and in ASME paper No. 73-WA/PT-2, by C. Etherington, entitled, "Conform — A New Concept for the Continuous Extrusion Forming of Metals".

With particular reference to the extrusion technique disclosed in the two Green patents and the ASME paper, the use of a stationary member to engage a workpiece and maintain the workpiece within a groove in a rotary member necessarily imposes upon the workpiece a frictional resistance, due to the contact with the surface of the stationary member, which opposes the advance of the workpiece toward the die. This is clearly a source of inefficiency in the extrusion process. Moreover, such process does not readily permit the provision of efficient mechanisms for supporting a continuously increasing compressive pressure to which the advancing workpiece is subjected during hydrostatic extrusion of the workpiece.

A technique which seeks to overcome the frictional resistance problem associated with the extrusion process taught in the Green patents and the ASME paper is disclosed in U.S. Pat. No. 3,911,705 to W. G. Voorhees. The Voorhees approach utilizes a flexible band between the stationary member and the workpiece, the band being permitted to advance with the rotary member and the workpiece, and having a lubricant on the surface of the band which contacts the stationary member in order to minimize the frictional drag on the workpiece. However, no mechanism is available in such an arrangement for providing an effective seal about the edges of the band so as to prevent entry of lubricant into the groove in the rotary member, such as might cause contamination and/or rod slippage, and so as also to prevent flash metal extrusion about the periphery of the band at high pressures. Moreover, the use of a relatively thin, flexible band maintained in tension limits the maximum extrusion pressure which the apparatus can support.

Two further processes, which are of some interest in connection with the continuous deformation of an elongated workpiece of indefinite length, so as to form an elongated product of indefinite length, are disclosed in U.S. Pat. No. 3,922,898 to W. G. Voorhees, and in an article by Betzalel Avitzur entitled, "Extrolling: Combining Extrusion and Rolling", in the July 1975 issue of *Wire Journal* at page 73. Each of these publications discloses the provision of two circular blocks or rolls, which are mounted on parallel axes such that their radially outermost surfaces cooperate to define a region therebetween for gripping an elongated workpiece. Simultaneous rotation of the two circular blocks or rolls causes an elongated workpiece extending tangentially into such region to advance tangentially therewith, so as to be extruded through a suitably positioned die which projects into the path of the advancing workpiece. In addition, the Avitzur article describes a rolling operation taking place as the workpiece is advanced between the rolls and into the die, such article also describing the presence of a protrusion on the radially outermost surface of one of the rolls, mated with a groove on the radially outermost surface of the other roll to form the workpiece gripping region. Clearly, the length of contact between the workpiece and the circular blocks or rolls is relatively limited in systems of this general type, and consequently, the maximum extrusion pressure which can be imparted to the advancing workpiece is similarly limited.

Clearly, it would be quite advantageous to provide improved methods for deforming an elongated workpiece of indefinite length so as to produce an elongated product of indefinite length, which improved methods avoid the previously mentioned shortcomings of certain of these techniques.

SUMMARY OF THE INVENTION

The invention contemplates the utilization of workpiece deforming mechanisms in which two members are moved simultaneously, at least one, and preferably both, of the members being moved by rotation, and in which the two simultaneously moved members cooperate to advance an elongated workpiece of indefinite length continuously into a deforming agency, such as an extrusion die. Portions of radially extending surfaces of at least one, and preferably of both, of the members are utilized to grip an elongated workpiece therebetween, in order to effect such advance of the workpiece with the rotating two members. An annular groove may extend along the appropriate radially extending surface of one of the two rotating members. Such annular groove serves to retain the elongated workpiece therein while guiding the elongated workpiece along a path leading to the deforming agency. The two members may each be driven directly, e.g., at different speeds of rotation, but preferably provide like tangential velocities at a position of entry of the elongated workpiece into the deforming agency. The two members may advantageously be rotated about different, non-parallel axes, the axes being so disposed that the two members are positioned closest to one another at the position of entry of the elongated workpiece into the deforming agency. Thus, the pressure applied from the two rotating members to the elongated workpiece will increase as the elongated workpiece advances toward the deforming agency, such pressure increase corresponding to a similar pressure increase in the advancing workpiece. The face-to-face arrangement of the two members along their respective radially extending surfaces provided by the invention permits a very high extrusion pressure to be supported, while also allowing effective sealing of the annular groove at such very high extrusion pressure.

BRIEF DESCRIPTION OF THE DRAWING

FIG. 2 is an enlarged horizontal section through a portion of the apparatus, taken along the line 2—2 in FIG. 1, looking down on a lower one of two rotors included in the apparatus, FIG. 2 also including a phantom line indicating the position of the upper rotor relative to that of the illustrated, lower rotor;

FIG. 3 is an enlarged isometric view of a portion of a rod suitable for extrusion by the apparatus of FIG. 1;

DETAILED DESCRIPTION

Figure 1:
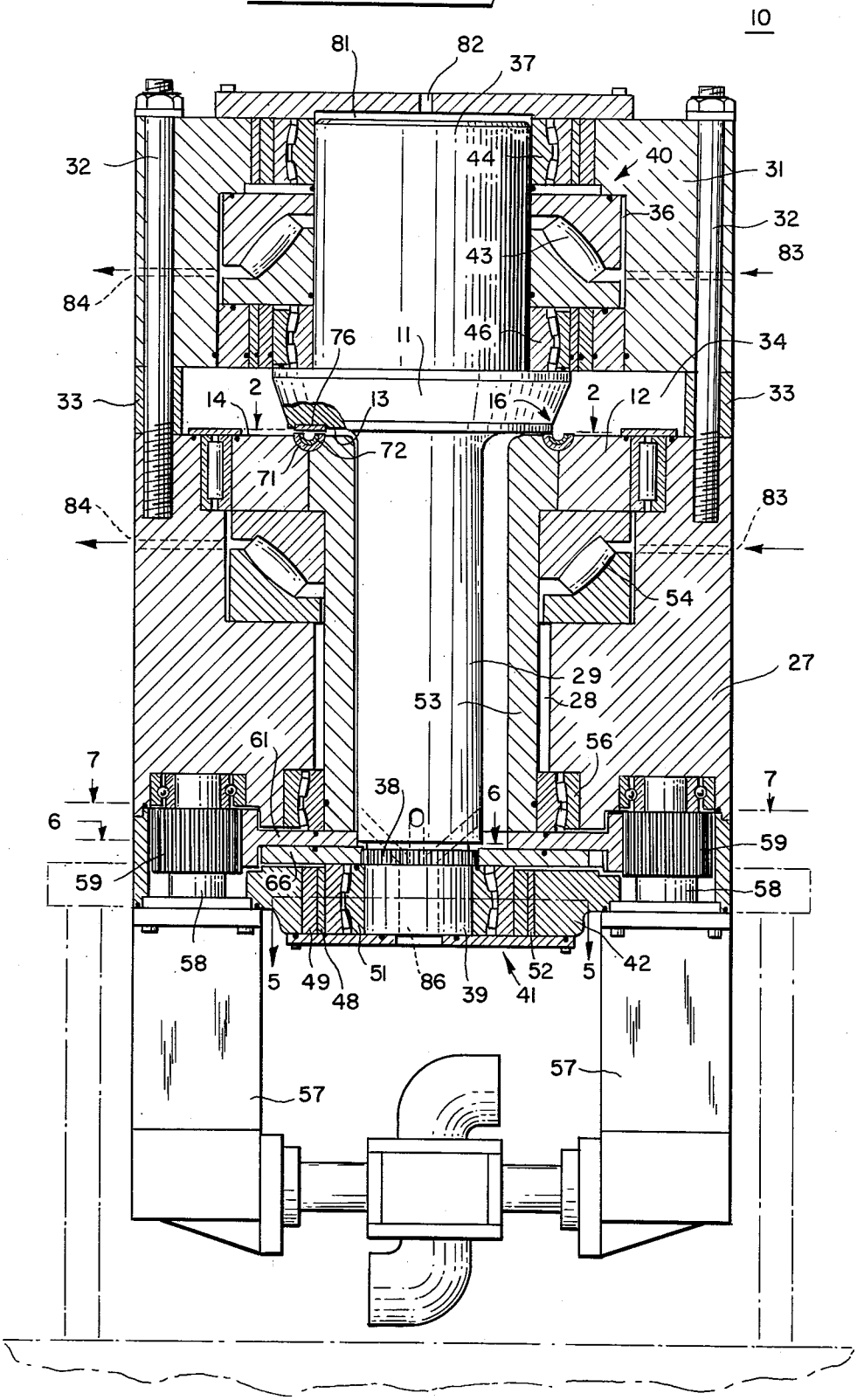
FIG. 1 of the drawing is a vertical, side view, partly in section, illustrating a hydrostatic extrusion apparatus which may be employed, in accordance with the principles of the invention, in continuously deforming a rod of indefinite length so as to form a wire of indefinite length.

Referring initially to FIGS. 1, 2, 8 and 9 of the drawing, in general, an apparatus 10, which may be utilized in the continuous hydrostatic extrusion of a rod or other elongated workpiece of indefinite length so as to form a wire or other elongated product of indefinite length, includes a pair of rotors 11 and 12. The two rotors are mounted for rotary movement, preferably about two generally vertical axes, as will be described more fully hereinafter, with a radially extending surface 13 on rotor 11 facing a radially extending surface 14 on rotor 12. An annular groove 16, for receiving and retaining an elongated workpiece, extends along surface 14 of rotor 12, i.e., along the top surface of the lower rotor. The annular groove 16 may have a generally "U"-shaped cross-section, and may be employed in the deformation of an elongated workpiece of indefinite length, such as the rod 17 shown in FIG. 3 of the drawing, having a semicircular section portion 18 and a rectangular section portion 19. Such rod may be formed, for example, by techniques disclosed in my copending application, Ser. No. 638,494, filed Dec. 8, 1975, and may be composed of copper, aluminum, or any other suitable material.

The two rotors 11 and 12 are mounted on their respective axes, with the position of rotor 11 being somewhat eccentric relative to rotor 12, as indicated by the phantom line in FIG. 2 of the drawing. As may be seen in FIG. 2, rotor 11 has a diameter considerably smaller than that of rotor 12, e.g., a diameter approximately equal to that of the annular groove 16 in rotor 12. The rotors 11 and 12 are so positioned that, at any instant during the simultaneous rotation of the two rotors, a first arcuate portion of the annular groove 16, i.e., the portion of the annular groove shown at the left in FIG. 2 and depicted in FIG. 9, will be covered by radially extending surface 13 of rotor 11, while a second arcuate portion of the annular groove 16, i.e., the portion of the annular groove shown at the right in FIG. 2 and depicted in FIG. 8, will be left uncovered by radially extending surface 13. The rod 17 (FIG. 3) is to be retained within the covered, first portion of the annular groove 16 with a flat surface 21 of the rod, constituting the edge of the rectangular section portion 19 most remote from the semicircular section portion 18, overlying surface 13.

A die 22 (FIG. 2), which may include one or more die apertures of circular or other shape, is mounted on a curved die stem 23, which is secured to a fixed supporting member 24. The die and die stem assembly projects into the annular groove 16 in rotor 12 and extends through part of the covered, first arcuate portion of the annular groove and through part of the uncovered, second arcuate portion of the annular groove. The two rotors 11 and 12 are to be rotated together, in a counterclockwise direction in the illustration of FIG. 2, about their respective axes. Upon such rotation, the rod 17 will be drawn into the annular groove 16 along the right side of the annular groove as depicted in the drawing, will advance along an arcuate path while gripped between the two rotors 11 and 12, and will pass through the die 22 so as to be extruded as one or more wires 26 of indefinite length, each such wire 26 thereupon exiting from the apparatus 10 through the curved die stem 23 and the fixed supporting member 24.

Turning now to FIGS. 1 and 4–7 of the drawing, the apparatus 10 will next be described in greater detail. A block 27 includes a generally cylindrical central aperture 28, through which there extends a first axial portion 29 of a shaft of rotor 11. A head 31 is secured upon the block 27, e.g., by means of a number of bolts 32 which pass through a number of spacers 33. Each of the spacers 33 has a longitudinal, i.e., vertical dimension approximately equal to that of rotor 11, such that a relatively open area 34 is defined between the block 27 and the head 31 for receiving rotor 11. A generally cylindrical central aperture 36 in the head 31 receives a second axial portion 37 of the shaft of rotor 11 located at an upper end thereof. A pinion 38 is keyed to the shaft of rotor 11 between the first axial portion 29 of the shaft and a third axial portion 39 of the shaft located at a lower end thereof.

Figure 4:
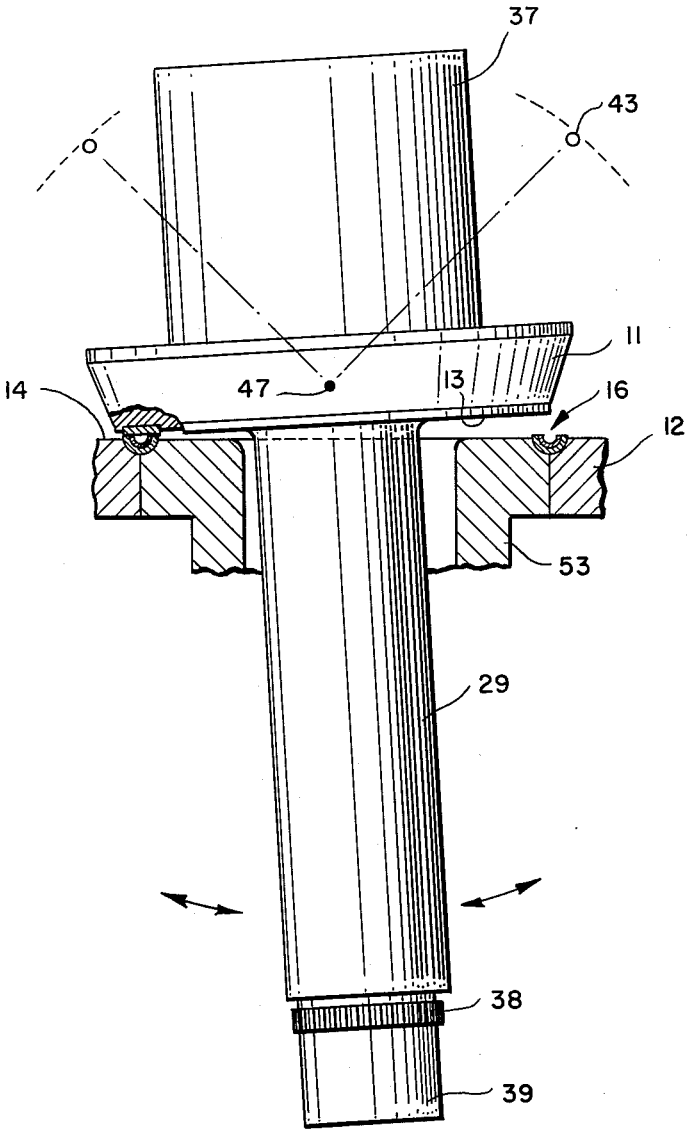
FIG. 4 is a diagrammatic view, illustrating, in somewhat exaggerated manner, a tilted orientation of one of the two rotors included in the apparatus of FIG. 1, relative to the other rotor.
Figure 5:
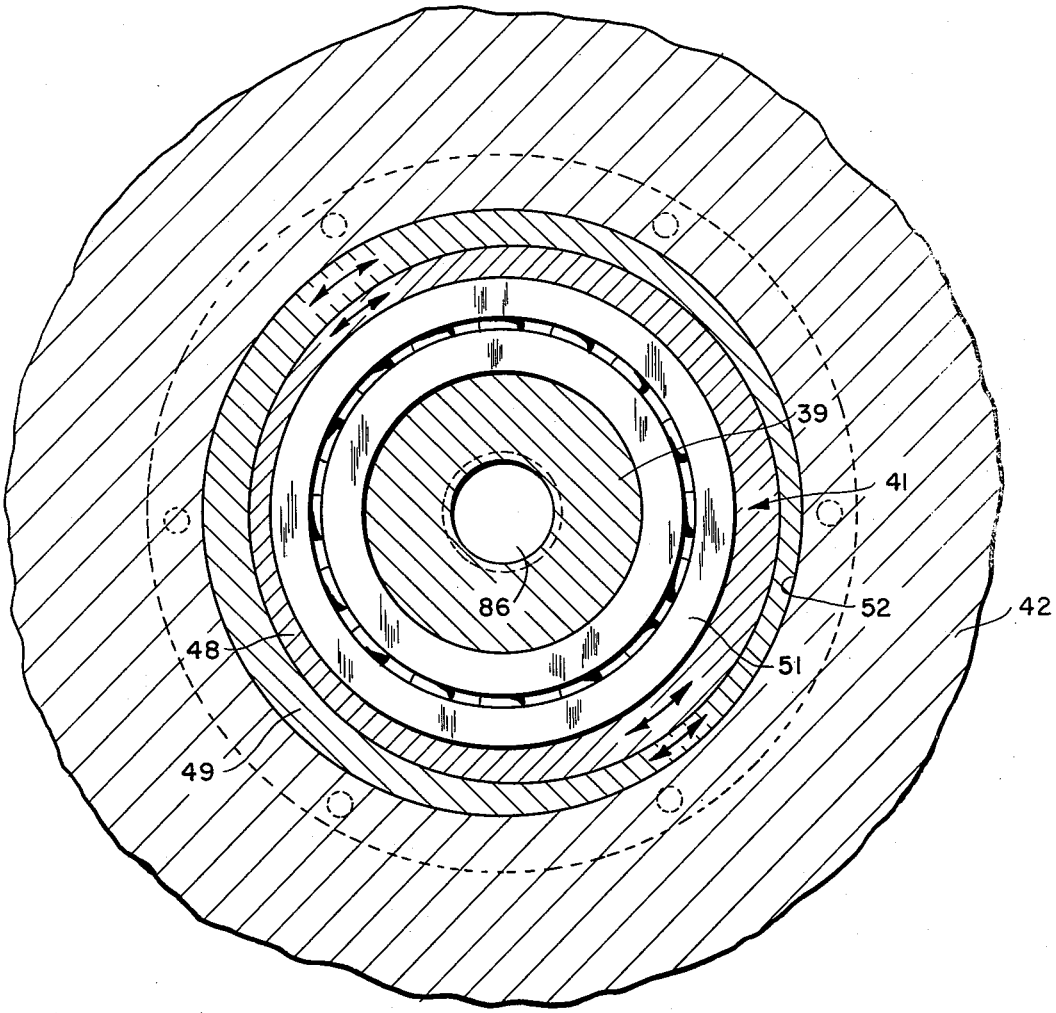
FIGS. 5, 6 and 7 are enlarged horizontal sections through portions of the apparatus, taken along the respective lines 5—5, 6—6 and 7—7 in FIG. 1, with certain features omitted where considered necessary in order to depict more clearly certain other features.
Figure 6:
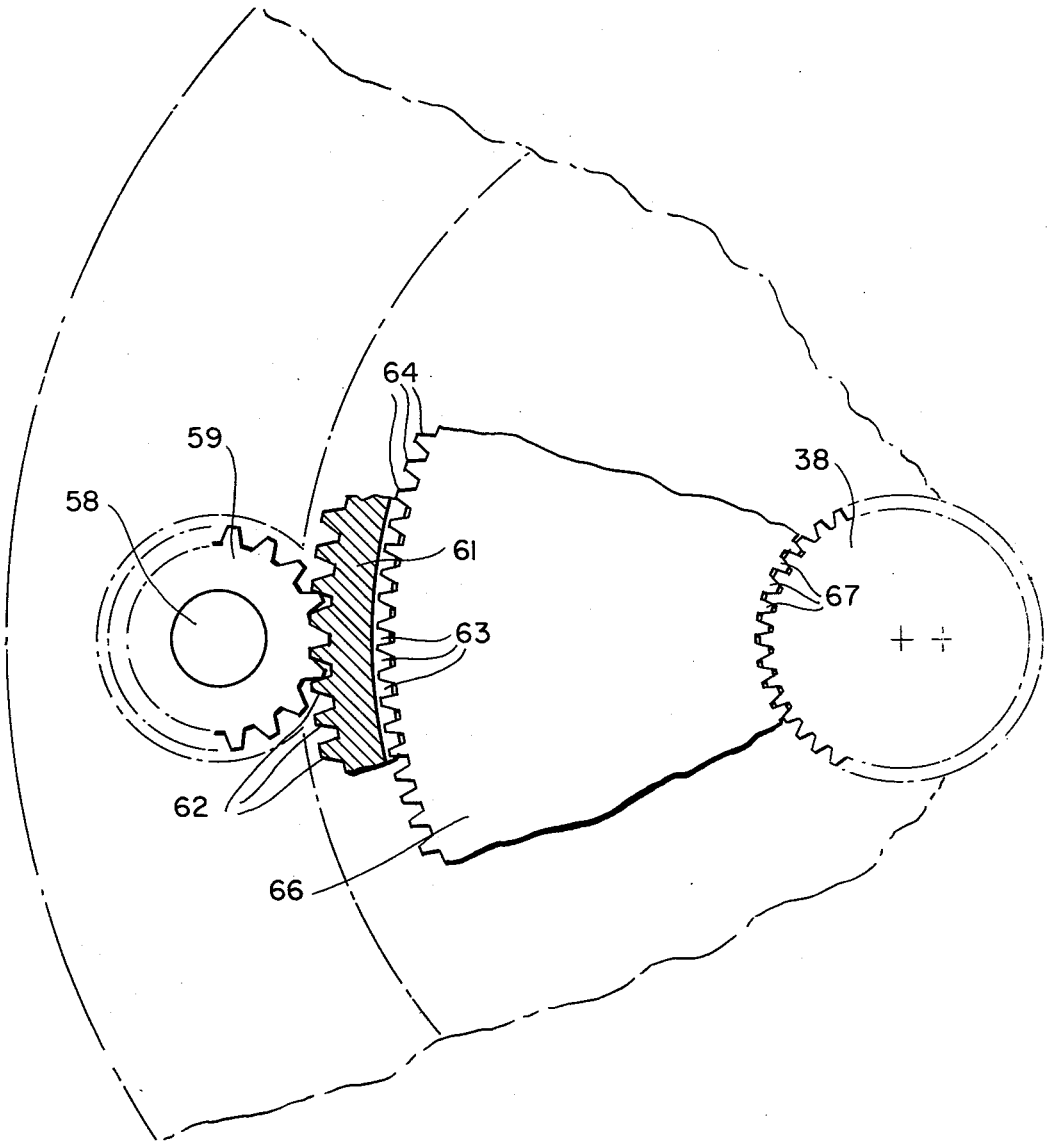
Figure 7:
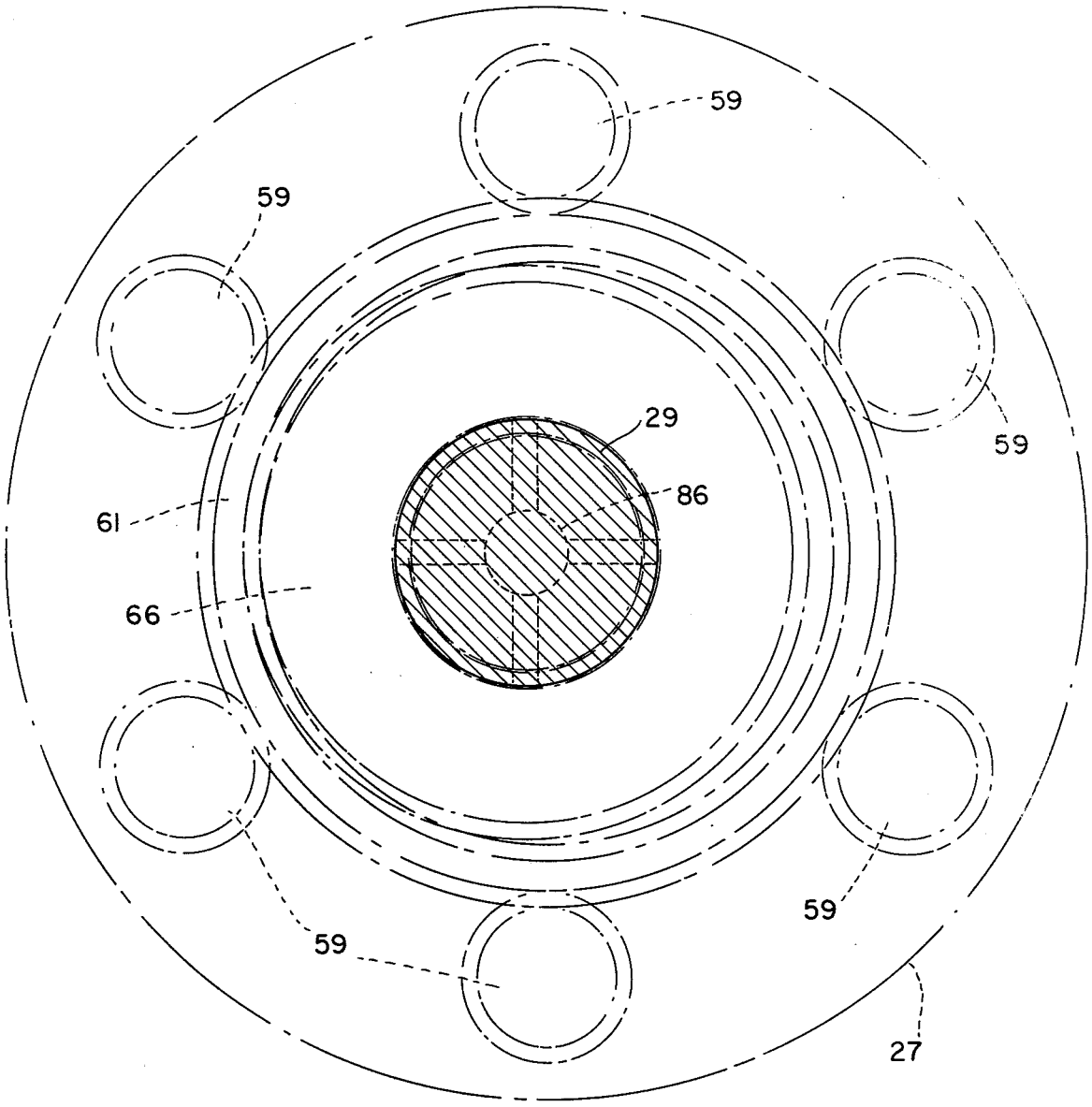

Rotor 11 is mounted for rotation about the longitudinal centerline of its shaft by means of a first bearing assembly 40, which is retained within the generally cylindrical central aperture 36 in the head 31 and which surrounds the second axial portion 37 of the shaft, and a second bearing assembly 41, which is retained in a fixed base plate 42 and which surrounds the third axial portion 39 of the shaft. The first bearing assembly 40 includes a large, self-aligning, rotary thrust bearing 43, the upper and lower races of which are permitted a limited degree of horizontal movement within generally cylindrical aperture 36. Rotary thrust bearing 43 is surrounded by a pair of additional self-aligning bearings 44 and 46. The entire first bearing assembly 40, as may be observed in FIG. 4 of the drawing, is adapted to permit at least a moderate degree of tilt of the shaft of rotor 11 relative to the vertical about a center of rotation 47 defined by the structure of rotary thrust bearing 43. The degree of tilt shown in FIG. 4 is, of course, greatly exaggerated for purposes of illustration.

The second bearing assembly 41 includes inner and outer annular adjusting members 48 and 49, and a self-aligning bearing 51, which receives the third axial portion 39 of the shaft of rotor 11, and which is retained within the inner adjusting member 48. The outer retaining member 49 is supported within a circular aperture 52 through the fixed base plate 42. As may be seen in FIG. 5 of the drawing, the inner and outer adjusting members 48 and 49 are so configued that the location of the center of the rotor shaft relative to the center of the circular aperture 52 may be adjusted by an appropriate selection of the relative attitudes of the inner and outer adjusting members 48 and 49 within the circular aperture 52. Such selection will, of course, determine the degree of tilt about the center of rotation 47 which the axis of the shaft of rotor 11 will assume relative to the vertical. In setting up the apparatus 10 for operation, the direction of tilt will be adjusted such that the two rotors 11 and 12 are positioned most closely adjacent to one another in the immediate vicinity of the die 22, with the degree of tilt selected on the basis of the maximum pressure which is to be present in the advancing elongated workpiece 17 between the rotors 11 and 12 in such vicinity. Thus, rotation of the two rotors will cause the gap between the rotors to decrease with movement of the workpiece 17 toward the die 22, in order substantially to match the profile of a pressure build-up in the advancing rod 17.

Rotor 12 has a hollow shaft 53 with an outer diameter smaller than the diameter of generally cylindrical central aperture 28 in the block 27. Shaft 53 extends vertically through the block 27, with the first axial portion 29 of the shaft of rotor 11 passing through the bore of shaft 53. Shaft 53 is mounted for rotation about its longitudinal centerline by means of a large, self-aligning, rotary thrust bearing 54 and an additional self-aligning bearing 56, both of which are retained within generally cylindrical central aperture 28. The upper and lower races of rotary thrust bearing 54 are permitted a limited degree of horizontal movement within aperture 28 in order to compensate for variations and/or non-uniformities in loading. The inner diameter of the hollow shaft 53 is sufficiently larger than the diameter of the first axial portion 29 of the shaft of rotor 11 to allow the clearance required both for the aforementioned eccentricity of the axis of rotor 11 and its shaft relative to the axis of rotor 12 and shaft 53, and for a moderate degree of tilt of the shaft of rotor 11 relative to the vertical axis of shaft 53.

A number of fluid motors 57 are mounted on the base plate 42. Each of the motors 57 has an output shaft 58 on which there is mounted a drive pinion 59. As may best be seen in FIGS. 6 and 7 of the drawing, the several drive pinions 59 are mounted so as to drive a common, first annular gear 61, which is fixed to the hollow shaft 53 of rotor 12 (FIG. 1) by suitable means (not shown), such as bolts. The first annular gear 61 has a set of external teeth 62 for engaging the teeth of the drive pinions 59, and a set of internal teeth 63. Internal teeth 63 are so disposed on the first annular gear 61 as to engage a set of external teeth 64 of a second annular gear 66, mounted eccentrically within the center of the first annular gear 61, such engagement taking place along a portion of the outer periphery of the second annular gear 66, since the outer diameter of the second annular gear 66 is somewhat smaller than the inner diameter of the first annular gear 61. A set of internal teeth 67 on the second annular gear 66 is maintained in continuous engagement with the teeth of the pinion 38 which is associated with the shaft of rotor 11. The arrangement is such that, upon rotation of the drive pinions 59, each of the rotors 11 and 12 will be rotated directly, i.e., neither rotor will operate to drive the other by means of frictional forces. Thus, the first annular gear 61 will be driven so as to rotate the rotor 12 through shaft 53 about a vertical axis, while also driving the second annular gear 66 through the intermeshed sets of teeth 63 and 64 in order to rotate pinion 38 and thereby cause rotor 11 to rotate about its slightly tilted axis. The depth of teeth 63 and 64 on the respective annular gears 61 and 66 is sufficient to maintain driving contact between such gears in spite of the slight tilt of the axis of rotor 11 and its shaft.

It may be noted that the speeds of rotation of the two annular gears 61 and 66, and thus, the speeds of rotation of the two rotors, will be different, as a result of the reduced size of the second annular gear 66. It is considered advantageous, however, that the tangential speeds of the two rotors be substantially identical in the vicinity of the die 22, in order that there be a maximized driving force tending to advance the rod 17 into the die. Such substantial identity of tangential speeds may be achieved by selecting pitch diameters for the respective sets of teeth 63 and 64 of the two annular gears 61 and 66 (FIG. 6) which are in a ratio corresponding to the ratio between the distances A and B (FIG. 2) from the axes of the two rotors 12 and 11, respectively, to a position of entry 68 of the advancing rod 17 into the die 22, i.e., a position along the annular groove 16 slightly upstream of the mouth of the die. Preferably, the point of closest approach of the tilted rotor 11 to the annular groove 16 in rotor 12 will correspond to the position of entry 68 at which the tangential speeds of the two rotors will be alike.

Figure 8:
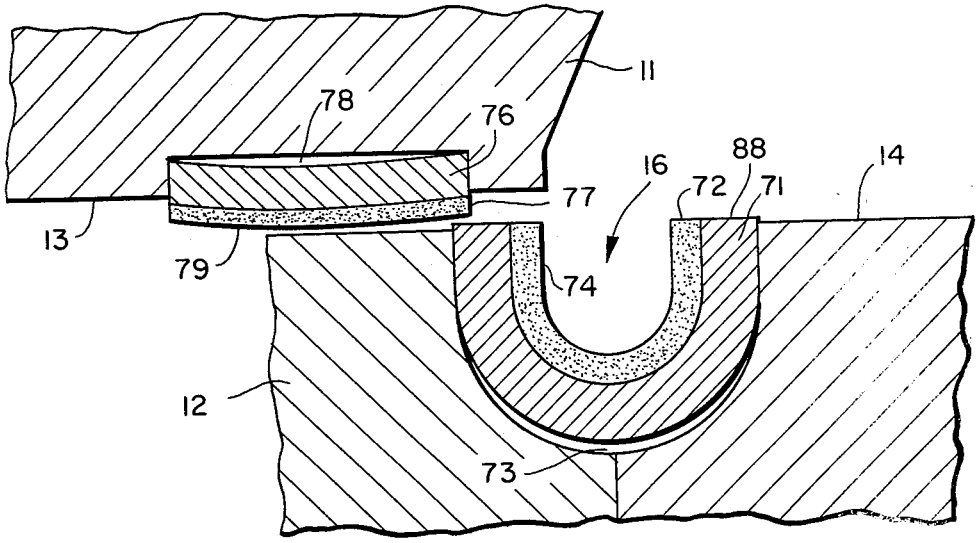
FIGS. 8 and 9 are enlarged longitudinal sections of portions of the two rotors of the apparatus, the respective portions being disposed in approximately diametrically opposite locations on the two rotors.
Figure 9:
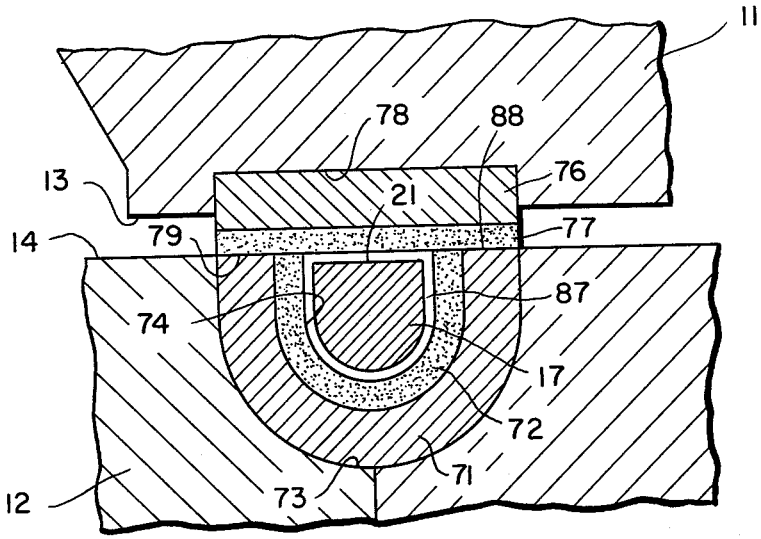

Turning now to FIGS. 8 and 9 of the drawing, the annular groove 16 is preferably disposed within a readily replaceable, liner assembly which includes a base element 71 and a surface element 72. Each of the two elements 71 and 72 takes the form of an annular member having a generally "U"-shaped cross-section, with surface element 72 retained within the bight of base element 71, e.g., by brazing. The liner assembly is shrink-fitted into an annular recess 73 in radially extending surface 14 of rotor 12, with an inner wall 74 of the surface element 72 serving to define the annular groove 16. The shrink-fit relationship of the liner assembly in the annular groove 16 tends to create compressive prestresses within the liner assembly in two ways. Firstly, the entire liner assembly is prevented by the walls of the annular recess 73 from a tendency to expand radially outwardly to a normally greater radius. Secondly, the "U"-shaped cross-section of the liner assembly is also prevented from expanding, into a normally more open "U"-shaped configuration. An upper portion of the liner assembly extends slightly outwardly from the radially extending surface 14 of rotor 12 along that portion of the annular groove 16 which, at any particular instant, is not covered by rotor 11, a slight clearance space being present at the bottom of annular recess 73 beneath the liner assembly, as shown in FIG. 8. Base element 71 may be formed of a suitable high strength material, such as high strength tool steel, while surface element 72 may be composed of a high modulus of elasticity, high compressive strength material having acceptable wear properties, such as tungsten carbide.

A readily replaceable, facing ring assembly includes a base element 76 and a surface element 77. Each of the two elements 76 and 77 takes the form of a flat annular member, with base element 76 being shrink-fitted into an annular recess 78, located close to the outer periphery of radially extending surface 13 of rotor 11, and with surface element 77 retained, e.g., by brazing, in face-to-face contact with base element 76. Base element 76 may be formed of a material similar to that of base element 71, while surface element 77 may be composed of a material similar to that of surface element 72. As may be seen in FIG. 8, base element 76 and surface element 77 tend to be bowed somewhat outwardly in their central regions along portions of the facing ring assembly which do not cover the annular groove 16 in rotor 12. However, where the annular groove 16 is covered by the tilted rotor 11, as shown in FIG. 9, a lower face 79 of surface element 77 serves to enclose the annular groove, with each of the liner and facing ring assemblies being forced into its respective recess 73 or 78 due to the tilt and being so deformed as to be subjected to a relatively high degree of compressive stress along surface elements 72 and 77 as the two rotors 11 and 12 approach the extrusion die 22. Meanwhile, a relatively low level of tensile stress is generated in the remote surfaces of base elements 71 and 76. At such time, the combined liner assembly and facing ring assembly structure will function to provide an effective seal about the rod 17 within the annular groove 16.

Certain additional features of the apparatus 10 may be seen in FIG. 1 of the drawing. Thus, a sealed chamber 81 with a fluid entry port 82 may be provided atop the second axial portion 37 of the shaft of rotor 11 in order that fluid pressure means may serve to support some of the axial forces tending to drive the rotors 11 and 12 apart during extrusion. In addition, a cooling and/or lubricating medium may be supplied to the large rotary thrust bearings 43 and 54 through appropriate inlet passages 83, exiting through companion outlet passages 84, while a suitable discharge channel 86 may be provided for the removal of any foreign matter which may enter into the hollow center of the shaft 53.

In the operation of the apparatus 10, and in carrying out the methods of the invention, an initial length of the rod 17 may be first covered with a coating of a shear transmitting medium 87 (FIG. 9), which constitutes a fluent material of a type which will be described hereinafter. Such initial length is then fed, e.g., manually, into the annular groove 16 in the top, radially extending surface 14 of rotor 12 in such manner as to project into the gradually decreasing clearance beneath the bottom, radially extending surface 13 of rotor 11. Successive elements of the rod 17 may also receive a coating of the shear transmitting medium 87 prior to their entry into the annular groove 16, for example, as the incoming rod passes through a waxing assembly (not shown) which may be similar to those disclosed in my previously mentioned U.S. Pat. No. 3,740,985 and U.S. patent application Ser. No. 612,876, filed Sept. 12, 1975.

The shear transmitting medium 87, which constitutes the fluent material to be utilized in practicing the present invention, will next be described. Such a medium will desirably have a high viscosity and shear strength, be capable of lubricating the die 22, provide good wetting action on the rod 17, and have minimal viscosity variation with respect to pressure, temperature and shearing rate. Such a medium may otherwise be known as viscous fluid, and examples of such a suitable medium are beeswax and polyethylene wax. Accordingly, the term "wax" will be used hereafter to represent any such shear transmitting medium.

The fluid motors 57 are now energized, causing the rotation of drive pinions 59 and, thus, of annular gears 61 and 66. Rotation of annular gear 61 causes rotation of hollow shaft 53 and, thus, of rotor 12 about its vertical axis, while rotation of annular gear 66 causes rotation of pinion 38 and, thus, of rotor 11 about its tilted axis. The two rotors 11 and 12 are operated at different speeds of rotation. However, as explained previously, the arrangement is such that the tangential speeds of the two rotors are substantially identical in the vicinity of the position of entry 68 of the rod 17 into the die 22. The simultaneous rotation of the two rotors 11 and 12 causes the initial length of the rod 17 to advance toward and into the die 22 as the continuous extrusion process begins.

Considering now the action of the apparatus 10 on a single selected element of the rod 17 as it passes through the apparatus 10, the selected rod element is preferably initially coated with the wax 87 and is then drawn by preceding elements of the advancing rod into an uncovered segment of the annular groove 16 in the top surface 14 of lower rotor 12. Such segment is presently located along the right side of the groove, as shown in FIG. 2 and in FIG. 8. The selected rod element is thereupon caused to travel along an arcuate path within the corresponding segment of the annular groove 16 in the rotating rotor 12 so as to advance toward the die 22.

As the selected rod element is moved into a first location beneath the bottom surface 13 of rotor 11, while residing within the corresponding segment of the annular groove 16, the bottom surface 13 of rotor 11 and the top surface 14 of rotor 12 approach one another longitudinally, due to the tilt of the axis of rotor 11. Thus, the lower face 79 (FIG. 9) of surface element 77 of the facing ring assembly comes into contact with a common upper surface 88 of base element 71 and surface element 72 of the liner assembly at the corresponding segment of the annular groove 16, with the respective surface elements 77 and 72 surrounding the wax coating 87 on the selected element of the rod 17.

As rotation of the two rotors 11 and 12 about their respective, non-parallel axes continues, both the facing ring assembly and the liner assembly are caused to deform under the influence of longitudinal forces created by the narrowing of the longitudinal gap between the radially extending surfaces 13 and 14 of the respective rotors 11 and 12. As a result, the condition of FIG. 9 is attained, wherein the contacting surfaces 79 and 88 of the liner and facing ring assemblies are deformed into flat configurations, with surfaces 79, 88 and 14 being substantially coplanar. The liner assembly and facing ring assembly are now cooperating so as to seal the annular groove 16 tightly against loss of any of the wax 87 and against any flash extrusion of the material of the rod 17.

The selected element of the rod 17 has been subjected to continuously increasing compressive stresses from the moment of entry of the rod element into the previously mentioned first location, due both to the narrowing of the longitudinal gap between the rotors 11 and 12 and to the compressive stresses provided through the flexure of the liner and facing ring assemblies. The pressure level within the wax 87 surrounding the selected rod element has increased similarly. Shear forces, transmitted to the selected rod element by the wax 87 are now serving to advance the coated rod element toward the extrusion die 22. The stresses continue to increase with the advance of the selected rod element toward the die 22.

Continuing combined rotation of the two rotors 11 and 12 next brings the selected element of the rod 17, and the corresponding segment of the annular groove 16, to a second location, toward which the tilt of the axis of rotor 11 is oriented, namely the position of entry 68 of the rod 17 into the die 22 (FIG. 2). The compressive stresses reach a maximum, with the selected element of the rod 17 having attained a sufficient degree of ductility for hydrostatic extrusion of the element through the die 22 to take place. Meanwhile, due to the previously discussed selection of pitch diameter ratios for the two annular gears 61 and 66, the tangential speeds of the two rotors are substantially identical at the position of entry 68 so as to maximize the driving force on the selected rod element toward the die 22. The selected, wax-coated element of the rod 17 now advances into the die 22 and through the die aperture or apertures, exiting through the curved die stem 23 and the supporting member 24 as an element of the wire or wires 26. Meanwhile, with rotation of the two rotors 11 and 12 continuing, the corresponding segment of the annular groove 16 advances into position to accept another element of the rod 17 as the hydrostatic extrusion process continues.

It will be apparent that the face-to-face positioning of the two rotors 11 and 12, with their working surfaces constituting radially extending surfaces, enables the mounting of the rotors on the large, opposing, self-aligning thrust bearings 43 and 54, which bearing arrangement is advantageous for supporting very high extrusion pressures, particularly when aided by fluid pressure within the sealed chamber 81 atop the second axial portion of the shaft of rotor 11.

It is to be understood that the described methods are simply illustrative of a preferred embodiment of the invention. In other embodiments, a rod of appropiate size may be extruded without the use of any shear-transmitting medium through direct contact between the rod and the apparatus. Many other modifications may be made in accordance with the principles of the invention.

I claim:

1. A method of continuously deforming an elongated workpiece of indefinite length to produce an elongated product of indefinite length, said method comprising the steps of:

(a) providing, in a location adjacent to a deforming agency, a rotary first member and a moveable second member, the first and second members being so disposed that a radially extending first surface on the first member, said radially extending first surface being oriented to intersect an axis of the first member, faces a second surface on the second member; and (b) gripping the elongated workpiece between said radially extending first surface of the first member and said second surface of the second member; while (c) rotating the first member about said axis and simultaneously moving the second member in such direction as to advance the elongated workpiece toward and into the deforming agency, whereby an elongated product is produced.

2. A method of continuously deforming an elongated workpiece of indefinite length to produce an elongated product of indefinite length, said method comprising the steps of:

(a) providing, in a location adjacent to a deforming agency, a rotary first member and a movable second member, the first and second members being so disposed that a radially extending first surface on the first member, said radially extending first surface being oriented to intersect an axis of the first member and having an annular groove located therein, faces a second surface on the second member; and (b) gripping the elongated workpiece between said radially extending first surface of the first member and said second surface of the second member with the elongated workpiece maintained in said annular groove in said radially extending first surface of the first member by said second surface of the second member; while (c) rotating the first member about said axis and simultaneously moving the second member in such direction as to advance the elongated workpiece toward and into the deforming agency, whereby an elongated product is produced.

3. A method as set forth in claim 3, wherein step (c) comprises:

(d) rotating the first member about said axis while maintaining said axis so disposed as to position the radially extending first surface of the first member and the second surface of the second member most closely adjacent to one another as the elongated workpiece reaches a position of entry into the deforming agency, such that pressure applied from the radially extending first surface of the first member and the second surface of the second member to the elongated workpiece gripped therebetween will increase as the elongated workpiece advances toward said position of entry.

4. A method as set forth in claim 3, wherein step (d) comprises:

(e) rotating the first member about said axis while maintaining said axis so disposed as to position the radially extending first surface of the first member and the second surface of the second member most closely adjacent to one another substantially along a line of closest proximity, which line of closest proximity extends substantially parallel to said axis of the first member, as the elongated workpiece reaches a position of entry into the deforming agency.

5. A method as set forth in claim 3, further including the step of:

(e) applying a coating of a fluent material to the elongated workpiece prior to the performance of step (b), so that said increasing pressure on the advancing elongated workpiece will be applied to the elongated workpiece through said coating of fluent material.

6. A method as set forth in claim 3, wherein step (c) comprises:

(e) rotating the second member about an axis of rotation simultaneously with rotation of the first member about said axis of the first member, with the axis of rotation of the second member differing from said axis of the first member.

7. A method as set forth in claim 2, wherein step (c) comprises:

(d) rotating the first member about said axis while maintaining said axis substantially vertical, with the radially extending first surface of the first member and the facing, second surface of the second member maintained substantially horizontal.

8. A method for the continuous hydrostatic extrusion of an elongated product of indefinite length from an elongated workpiece of indefinite length, said method comprising the steps of:

(a) applying a coating of a fluent material to the elongated workpiece;

(b) providing, in a location adjacent to an extrusion die, a rotary first member and a moveable second member, the first member having a radially extending first surface, oriented to intersect an axis of the first member, and the second member having a second surface, the first and second members being so disposed that said radially extending first surface of the first member and said second surface of the second member face one another;

(c) gripping the coated elongated workpiece between said radially extending first surface of the first member and said second surface of the second member; while (d) rotating the first member about said axis and simultaneously moving the second member in such direction as to advance the elongated workpiece toward and into the extrusion die; and (e) applying a continuously increasing hydrostatic pressure to the coating on the elongated workpiece, corresponding to a continuously increasing pressure in the elongated workpiece, as the elongated workpiece is advanced toward the extrusion die.

9. A method as set forth in claim 8, wherein an annular groove is located in the radially extending first surface of the first member, step (c) comprising:

(f) gripping the coated elongated workpiece between said radially extending first surface of the first member and said second surface of the second member with the coated elongated workpiece maintained in said annular groove in said radially extending surface of the first member by said second surface of the second member.

10. A method as set forth in claim 8, wherein steps (d) and (e) comprise:

(f) rotating the first member about said axis while maintaining said axis so disposed as to position the radially extending surface of the first member and the second surface of the second member most closely adjacent to one another as the elongated workpiece reaches a position of entry into the extrusion die, such that pressure applied from the radially extending first surface of the first member and the second surface of the second member to the coating on the elongated workpiece gripped therebetween increases as the elongated workpiece advances toward said position of entry.

11. A method as set forth in claim 10, wherein step (d) comprises:

(g) rotating the second member about an axis of rotation simultaneously with rotation of the first member about said axis of the first member, with the axis of rotation of the second member differing from said axis of the first member.

12. A method as set forth in claim 10, wherein step (f) comprises:

(g) rotating the first member about said axis while maintaining said axis so disposed as to position the radially extending first surface of the first member and the second surface of the second member most closely adjacent to one another substantially along a line of closest proximity, which line of closest proximity extends generally parallel to said axis of the first member, as the elongated member reaches a position of entry into the extrusion die.

13. A method as set forth in claim 8, wherein step (d) comprises:

(f) rotating the first member about said axis while maintaining said axis substantially vertical, with the radially extending first surface of the first member and the facing, second surface of the second member maintained substantially horizontal.

14. A method of continuously deforming an elongated workpiece of indefinite length to produce an elongated product of indefinite length, said method comprising the steps of:

(a) providing, in a location adjacent to a deforming agency, two rotary members having respective radially extending surfaces which face one another, said radially extending surfaces each being oriented to intersect an axis of the respective rotary member, the axes of the two rotary members differing one from the other; and (b) gripping the elongated workpiece between said facing, radially extending surfaces on the two rotary members; while (c) rotating the two rotary members simultaneously about said two different axes, in such direction as to advance the elongated workpiece toward and into the deforming agency, whereby an elongated product is produced.

15. A method of continuously deforming an elongated workpiece of indefinite length to produce an elongated product of indefinite length, said method comprising the steps of:

(a) providing, in a location adjacent to a deforming agency, two rotary members having respective radially extending surfaces which face one another, said radially extending surfaces each being oriented to intersect an axis of the respective rotary member, with the facing, radially extending surface of one of the two rotary members including an annular groove, the axes of the two rotary members differing one from the other; and (b) gripping the elongated workpiece between said facing, radially extending surfaces of the two rotary members with the elongated workpiece maintained in the annular groove in said facing, radially extending surface of said one of the two rotary members by the facing, radially extending surface of the other of the two rotary members; while (c) rotating the two rotary members simultaneously about said two different axes, in such direction as to advance the elongated workpiece toward and into the deforming agency, whereby an elongated product is produced.

16. A method as set forth in claim 14, wherein step (c) comprises:

(d) rotating the two rotary members about said two different axes while maintaining said axes substantially vertical, with the facing, radially extending surfaces on the two rotary members maintained substantially horizontal.

17. A method as set forth in claim 15, wherein step (c) comprises:

(d) directly rotating each of the two rotary members.

18. A method as set forth in claim 15, wherein step (c) comprises:

(d) rotating each of the two rotary members at a different speed of rotation, but with like tangential velocities adjacent to a position of entry of the elongated workpiece into the deforming agency.

19. A method as set forth in claim 15, wherein step (c) comprises:

(d) rotating the two rotary members about two different, nonparallel axes.

20. A method of continuously deforming an elongated workpiece of indefinite length to produce an elongated product of indefinite length, said method comprising the steps of:

(a) providing, in a location adjacent to a deforming agency, two rotary members having respective radially extending surfaces which face one another for gripping the elongated workpiece therebetween; and (b) rotating the two rotary members simultaneously about two different, nonparallel axes, with the elongated workpiece gripped therebetween, in such direction as to advance the workpiece toward and into the deforming agency, whereby an elongated product is produced, said axes being so disposed as to position the two rotary members most closely adjacent to one another as the elongated product reaches a position of entry into the deforming agency, such that pressure applied from the two rotary members to the elongated workpiece will increase as the elongated workpiece advances toward said position of entry.

21. A method as set forth in claim 20, wherein step (b) further comprises:

(c) rotating each of the two rotary members at a different speed of rotation, but with like tangential velocities adjacent to said position of entry of the elongated workpiece into the deforming agency.

22. A method as set forth in claim 20, further including the step of:

(c) applying a coating of a fluent material to the elongated workpiece prior to the performance of step (b), so that said increasing pressure on the advancing workpiece will be applied to the elongated workpiece through said coating of fluent material.

23. A method as set forth in claim 20, wherein an annular groove is located in the facing, radially extending surface of one of the two rotary members, and wherein step (b) further comprises:

(c) rotating the two rotary members with the elongated workpiece maintained in the annular groove in said one of the two rotary members.

24. A method as set forth in claim 20, wherein step (b) further comprises:

(c) directly rotating each at the two rotary members.

25. A method for the continuous hydrostatic extrusion of an elongated product of indefinite length from an elongated workpiece of indefinite length, said method comprising the steps of:

(a) applying a coating of a fluent material to the elongated workpiece;

(b) providing, in a location adjacent to an extrusion die, two rotary members having respective radially extending surfaces which face one another for gripping the elongated workpiece therebetween;

(c) rotating the two rotary members simultaneously, with the coated elongated workpiece gripped therebetween, about two different axes, in such direction as to advance the elongated workpiece toward and into the extrusion die; and (d) applying a continuously increasing hydrostatic pressure to the coating on the elongated workpiece, corresponding to a continuously increasing pressure in the elongated workpiece, as the elongated workpiece is advanced toward the die.

26. A method as set forth in claim 25, wherein an annular groove is located in the facing, radially extending surface of one of the two rotary members, step (c) comprising:

(e) rotating the two rotary members with the elongated workpiece maintained in the annular groove in said one of the two rotary members.

27. A method as set forth in claim 25, wherein step (c) comprises:

(e) directly rotating each of the two rotary members.

28. A method as set forth in claim 25, wherein step (c) comprises:

(e) rotating each of the two rotary members at a different speed of rotation, but with like tangential velocities adjacent to a position of entry of the elongated workpiece into the extrusion die.

29. A method for the continuous hydrostatic extrusion of an elongated product of indefinite length from an elongated workpiece of indefinite length, said method comprising the steps of:

(a) applying a coating of a fluent material to the elongated workpiece;

(b) providing, in a location adjacent to an extrusion die, two rotary members having respective radially extending surfaces which face one another for gripping the elongated workpiece therebetween; and (c) rotating the two rotary members simultaneously about two different, nonparallel axes, with the coated elongated workpiece gripped therebetween, in such direction as to advance the elongated workpiece toward and into the extrusion die, said axes being so disposed as to position the two rotary members most closely adjacent to one another as the elongated workpiece reaches a position of entry into the extrusion die, such that a hydrostatic pressure applied from the two rotary members to the coating on the elongated workpiece increases continuously, corresponding to a continuously increasing pressure in the elongated workpiece, as the elongated workpiece advances toward said position of entry.

30. A method as set forth in claim 29, wherein step (c) further comprises:

(d) rotating each of the two rotary members at a different speed of rotation, but with like tangential velocities adjacent to said position of entry of the elongated workpiece into the extrusion die.

31. A method as set forth in claim 29, wherein an annular groove is located in the facing, radially extending surface of one of the two rotary members, step (c) further comprising:

(d) rotating the two rotary members with the elongated workpiece maintained in the annular groove in said one of the two rotary members.

32. A method as set forth in claim 29, wherein step (c) further comprises:

(d) directly rotating each of the two rotary members.

* * * * *

UNITED STATES PATENT OFFICE

CERTIFICATE OF CORRECTION

Patent No. 4,094,178 Dated June 13, 1978

Inventor(s) F. J. FUCHS, JR.

It is certified that error appears in the above-identified patent and that said Letters Patent are hereby corrected as shown below:

In the claims, claim 3, column 10, line 38, "claim 3," should read --claim 2, --.

Claim 16, column 13, line 4, "claim 14," should read --claim 15--.

Signed and Sealed this

Third Day of April 1979

[SEAL]

Attest:

RUTH C. MASON
Attesting Officer

DONALD W. BANNER
Commissioner of Patents and Trademarks